United States Patent [19]

Huau et al.

[11] Patent Number: 4,730,824

[45] Date of Patent: Mar. 15, 1988

[54] UNIT FOR THE GUIDANCE OF SHEETS OF FLEXIBLE MATERIAL FOR THE PURPOSE OF FORMING A THREE-DIMENSIONAL ASSEMBLY

[75] Inventors: Christian Huau, Fontenay aux Roses; Pierre J. A. Facon, Versailles; Alain Pelleray, les Clayes sous Bois, all of France

[73] Assignee: Bertin & Cie, Plaisir Cedex, France

[21] Appl. No.: 888,993

[22] Filed: Jul. 24, 1986

[30] Foreign Application Priority Data

Aug. 2, 1985 [FR] France ..... 85 11858
Aug. 2, 1985 [FR] France ..... 85 11859

[51] Int. Cl.[4] ..... B65H 7/14

[52] U.S. Cl. ..... 271/227; 271/251; 112/121.11; 112/262.3

[58] Field of Search ..... 271/227, 251; 112/121.11, 121.12, 121.15, 262.3, 306, 308, 322

[56] References Cited

U.S. PATENT DOCUMENTS 3,080,836 3/1963 Clemens ..... 271/227 X
3,650,229 3/1972 Rovin ..... 271/227 X
3,815,530 6/1974 Denton ..... 112/322 X
4,411,418 10/1983 Poehlein ..... 271/251 X
4,423,690 1/1984 Willenbacher ..... 112/308 X

FOREIGN PATENT DOCUMENTS 3043852 7/1982 Fed. Rep. of Germany .
3346163 4/1985 Fed. Rep. of Germany .
2503201 10/1982 France .

*Primary Examiner*—Richard A. Schacher
*Attorney, Agent, or Firm*—A. W. Breiner

[57] ABSTRACT

An apparatus for guiding flexible sheet material for forming a three-dimensional assembly including a drive device and an edge position detector. The drive device includes a spherical drive wheel moving about two perpendicular axes. A drive roller controls the rotation of the wheel in a vertical plane and a shaft controls its rotation in a horizontal plane. The apparatus provides for measurement of angular position and for control of rotation at the end of the shaft which carries the spindle of the drive wheel. The edge position detector is formed from a strip of photoelectric diodes, a light source, and electronic dircuits providing a control signal for the drive device.

7 Claims, 9 Drawing Figures

19
18
26
27
24
17
1
14
38
N
M
12
2
230
3
10
5
37
4
36
28
21
9

19
20
18

26
24
17
25
16
1
17
15
38
2
14
13
12
III
III
3
22
9
23
230
11
21
10
29
32
30
34
36
28
33
31
35

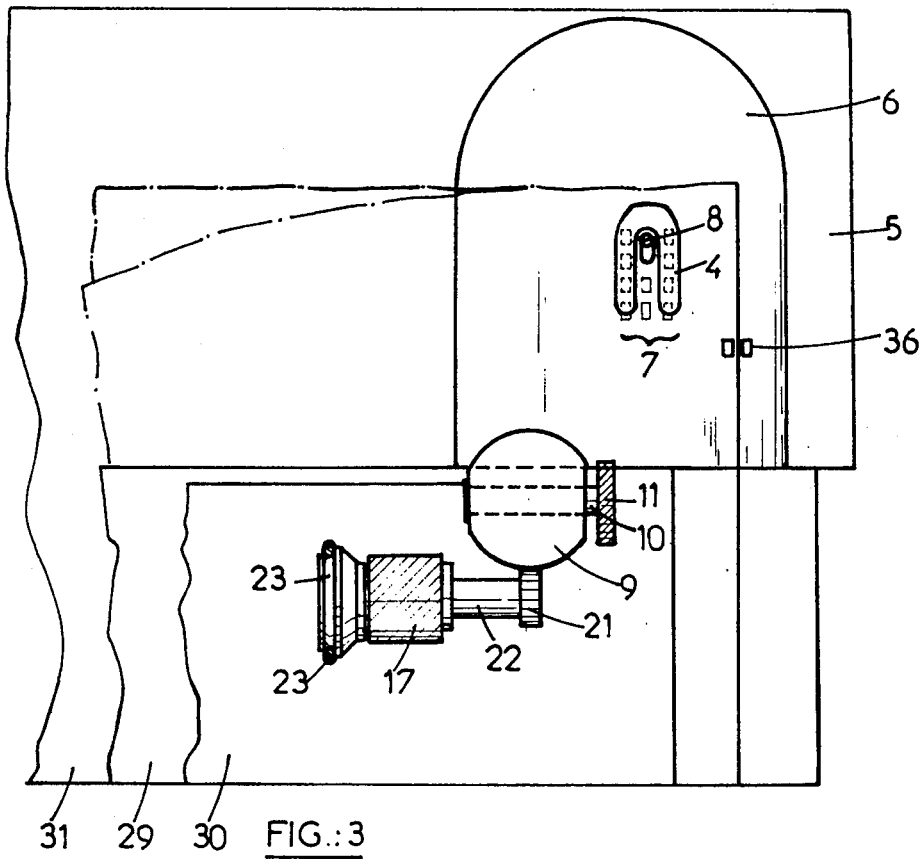
FIG.: 3
FIG.: 4
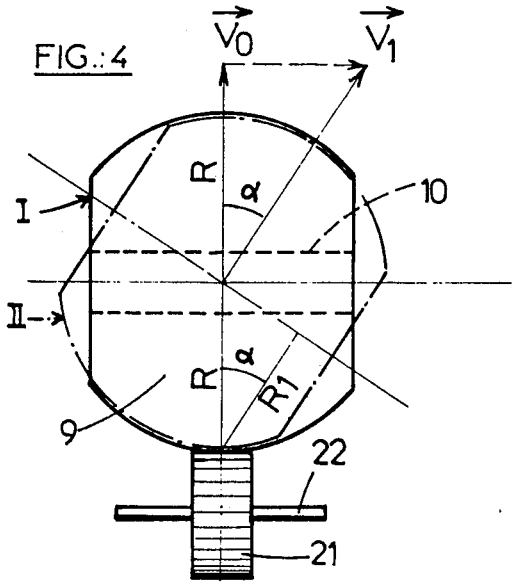

UNIT FOR THE GUIDANCE OF SHEETS OF FLEXIBLE MATERIAL FOR THE PURPOSE OF FORMING A THREE-DIMENSIONAL ASSEMBLY

FIELD OF THE INVENTION

The present invention relates to a unit for the guidance of sheets of flexible material for the purpose of forming a three-dimensional assembly, the said unit including a drive device formed from at least one bearing plate, a drive wheel pressing a sheet to be guided onto the bearing plate, means of control of the drive wheel, and a detector of the position of the edge of the sheet for controlling the drive device, the said detector including at least one photoelectric detector placed in front of the edge, used in the guidance of the piece of material and electronic circuits converting the signal provided by the photoelectric detector into a control signal for the drive device.

BACKGROUND OF THE INVENTION

The assembly of flexible parts into a three-dimensional shape is mainly encountered in the clothing industry. In effect the manufacture of clothing consists in assembling pieces of material that are more or less able to be shaped in order to form a surface intended to cover a volume. The assembly of the materials, whatever their texture, is carried out by sewing. Two cases can arise depending on whether or not the pieces can be superimposed prior to sewing.

In the first case, it is traditional sewing which, when completed, leaves the assembled parts flat. In the second case, it is necessary to guide separately each of the pieces under the needle and, once the sewing is completed, the assembled pieces can no longer be placed flat without producing folds on at least one of the pieces. This assembly gives a three-dimensional surface and is found, for example, in brassiere cups.

Traditional sewing machines generally include a mechanism for producing the interlocking of the sewing thread or threads and a material feed mechanism. This feed mechanism is formed from a claw with elliptical movement and and a pressure foot between which the material passes.

The longitudinal amplitude of displacement of the claw determines the length of the sewing stitch and is generally adjustable.

The pieces to be assembled are guided with respect to their edges which the operator superimposes as accurately as possible.

Normally a sewing machine is only capable of straight sewing. To obtain curved sewing it is necessary to superimpose on the feed, given by the claw of the machine, a movement of rotation about the needle.

These trajectory modifications must be made simultaneously on each of the pieces to be assembled.

Automatic machines are known which enable sewing to be carried out at a given distance from a curved edge of a piece of material. These machines include an actuator which comes into contact with the piece to be guided and impresses on it a movement of which one component has the effect of making it turn around the needle.

The actuator can appear in numerous forms, although it appears that only claw and wheel actuators have been developed in some way, with preference for the latter whose implementation is easier.

Wheel actuators of the known technique can be divided into two groups: those with a free wheel and a fixed direction, and those with a controlled wheel and a fixed direction.

French Pat. No. 2,241,648 describes an actuator of the first group whose free wheel makes a certain angle with the feed direction of the piece of material in such a way as to impose on it a movement of rotation, limited by the material edge stop along a guide whose curve corresponds with the orientation necessary for the formation of a piece of three-dimensional assembly sewing, the second piece of material possibly being guided by a same device.

This process has a certain number of disadvantages among which should be mentioned a use limited to materials that are sufficiently rigid that their edges can be effectively guided by the guide, and the necessity of having as many guides as there are sewing patterns and sizes.

These disadvantages are not found with a controlled wheel actuator, such as described, for example, in French Pat. No. 2,518,134. The wheel, whose axis of rotation is parallel to the material feed direction, is capable of being rotated in one direction or the other according to the information transmitted by a detector of the position of the edges of the piece of material. The guidance device also includes means of adjusting the pressure of the wheel on the material in order to ensure a contact pressure depending, among other things, on the material, the thickness and the weave.

The position detector includes at least one photoelectric detector arranged in front of one of the faces of a plate intended to separate, in order to enable their positioning, two pieces of material to be assembled by sewing.

The photoelectric detector comprises two pairs of light emitting diodes and photo-transistors. The referere-nce position, from which the edge of the material is checked, is that for which the edge is centered between the two diodes. Thus, in the reference position, we have the light emitted by the first diode and reflected by the separating plate which is interrupted by the material before being received by the corresponding photo-transistor while that emitted by the second diode and reflected by the plate is received by the corresponding phototransistor. A second similar photoelectric detector is mounted on the other surface of the separating plate in order to detect the edge of the second piece of material.

The electrical signals provided by the photoelectric detectors are sent into an electronic processor device which compares the signals received for each piece of material with reference values stored in memory and acts on the motor drive circuits of a device for the guidance of the pieces of material.

The control of the rotation of the wheel by the position detector, based on an all-or-nothing response, produces trajectory modifications that are relatively large and of short amplitude which create a crumpling of the material during the change of direction, and does not enable sewing of curves of small radius.

The use of a photoelectric detector using a wide light beam would enable the measurement of the hidden surface gradient and would consequently provide an analog signal which would be proportional to the position of the edge on two conditions: that the material is of uniform transparency and that the light beam is uniformly distributed along an elongated zone perpendicular to the edge of the material.

The analog device, no more than the logic system (all or nothing) cannot deal with materials of irregular transparency such as lace, net or printed materials with wide variations in density.

After cutting, perforated materials have very jagged edges and in extreme cases, in the case of nets, threads separated by spaces greater than their diameter. The presence of gaps inside the material in the field of the photoelectric detector prevents the use of simple analog sensors measuring the gradient of the hidden surface. The passing of the edge of a perforated material in front of a sensor assumed to be capable of detecting the precise position of the visible edge and not of the cut will give an analog signal reproducing the fluctuations of this visible edge. These fluctuations are due to the displacement of the line of cut in front of the sensor and to the presence of gaps in the material along this line. It is therefore necessary to know how to distinguish these two causes in order to reconstruct the line of cut which the sewing must follow.

SUMMARY OF THE INVENTION

The object of the invention is a guidance unit whose drive device includes a drive wheel which is orientable according to the desired curvature, whose speed of rotation is mechanically controlled by its orientation and whose detector of the position of the edge enables, from the detection of the visible edge of the material, the reconstruction of the line of cut parallel to which the sewing must be carried out.

The explanations and figures given hereafter by way of example will make it possible to understand how the invention can be embodied.

THE DRAWING AND DETAILED DESCRIPTION OF INVENTION

FIG. 3 is a view along III—III of FIG. 2.

FIG. 4 is a diagram showing the variation in speed of the wheel as a function of its orientation.

Figure 7:
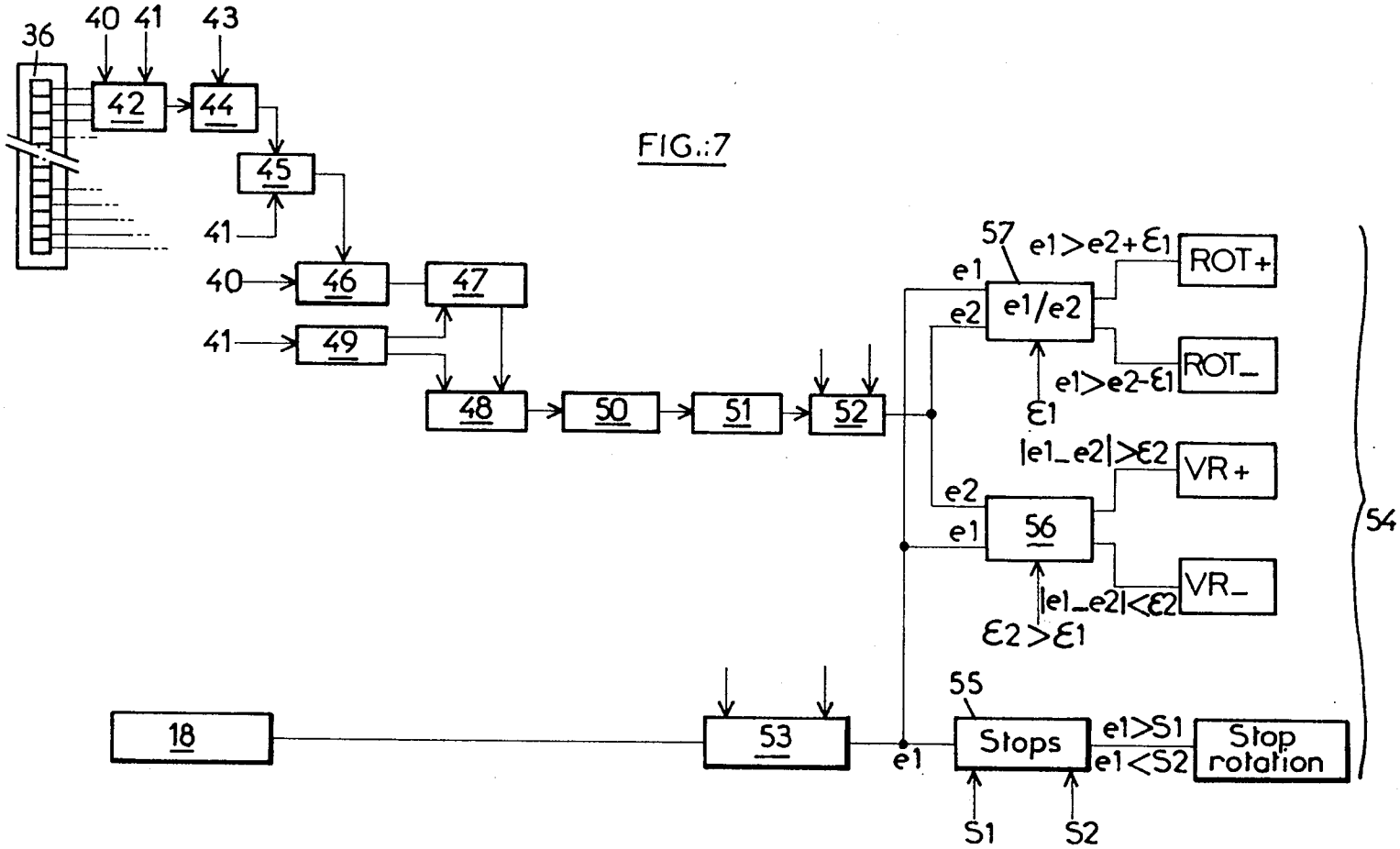
FIG. 7 shows the block diagram of the electronic device used for processing the signals from the edge detector for following the contour of the cut and, in the case of perforated materials, correcting the signals from those of the contours of the gaps before using them for controlling the device driving the pieces of material.
Figure 8:
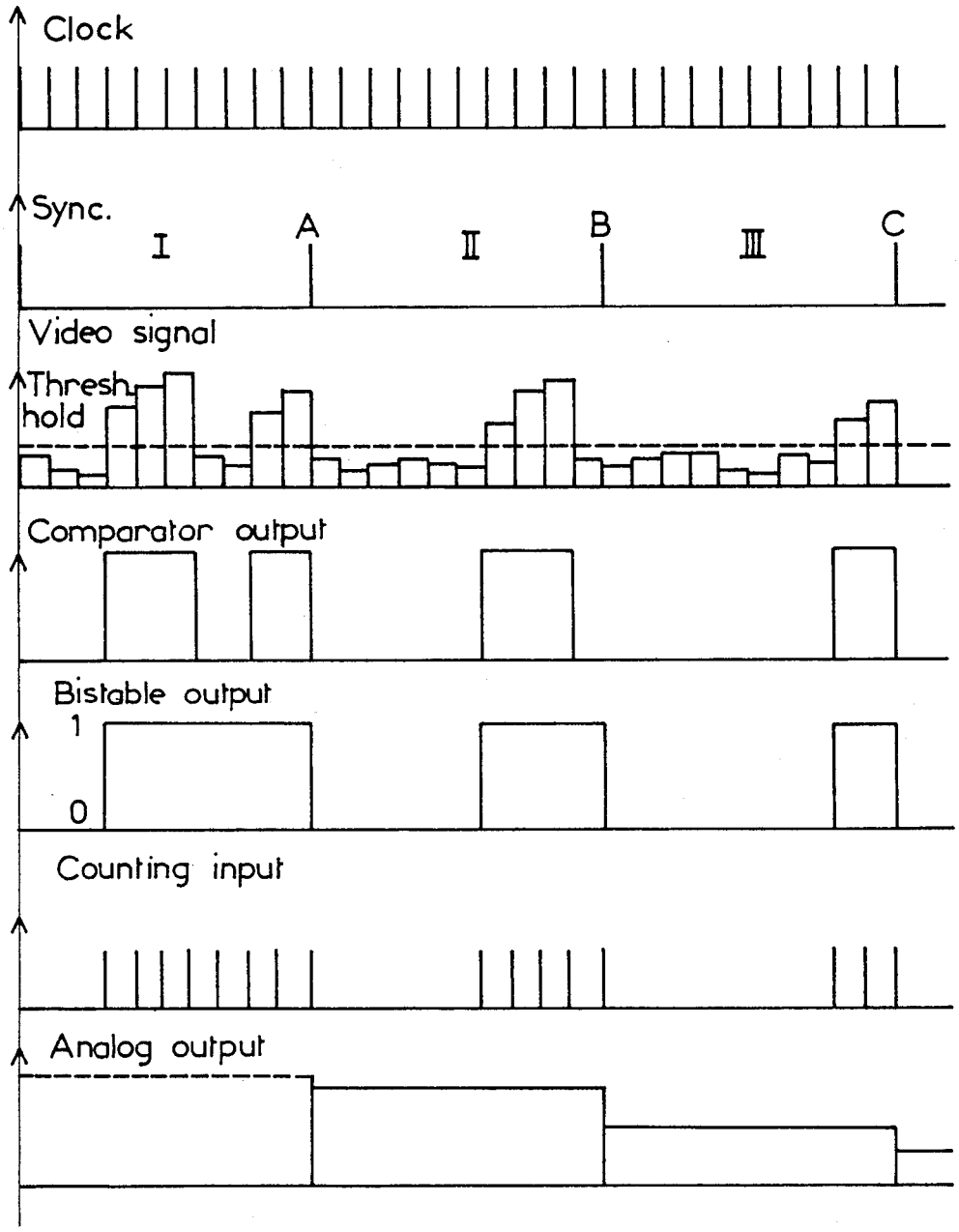

FIG. 8 gives the timing diagrams of the various signals obtained at the output of the circuits shown in the form of blocks in FIG. 7.

Figure 9:
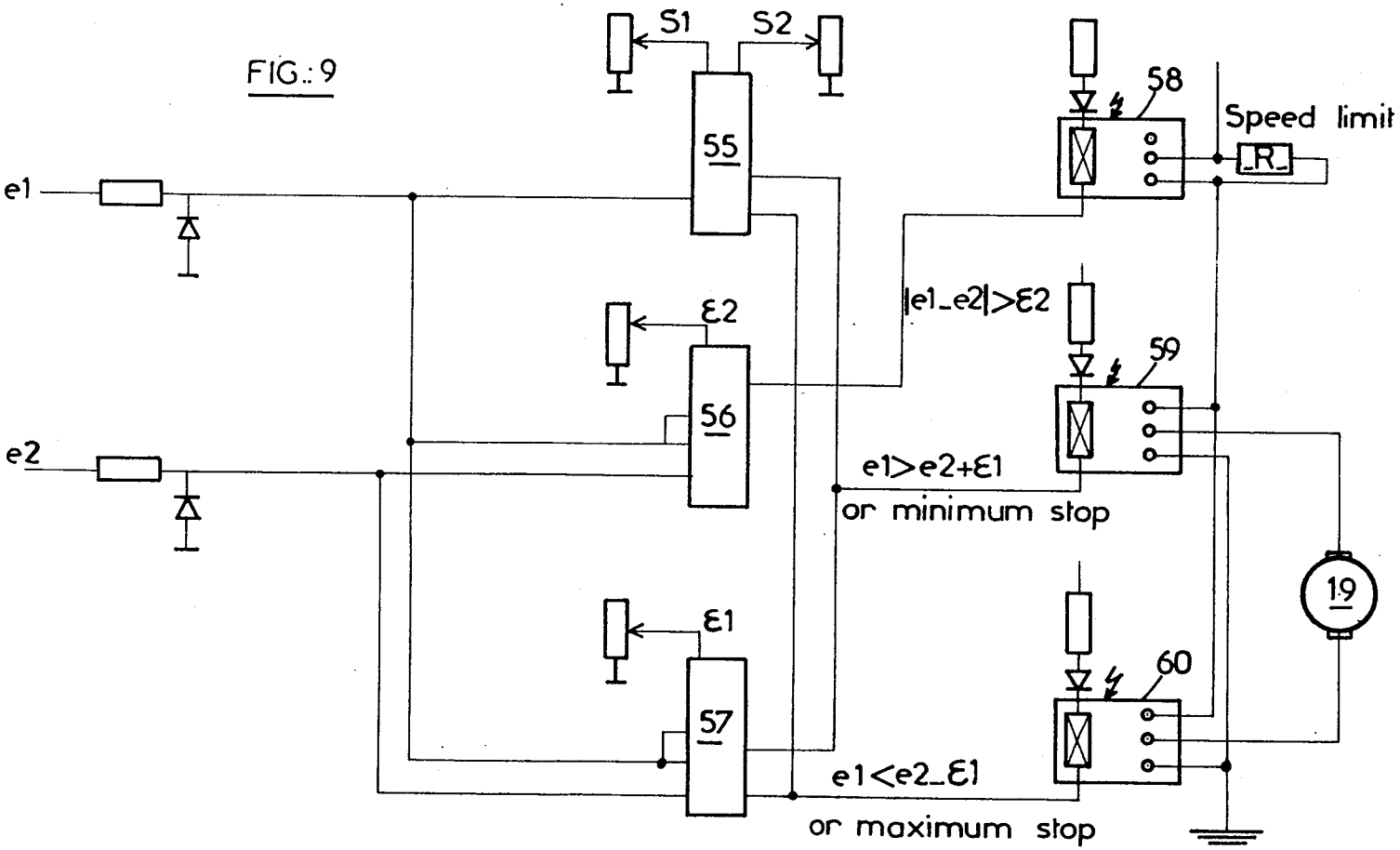

FIG. 9 is a diagram of the control circuit of the drive device.

Figures 1, 2:
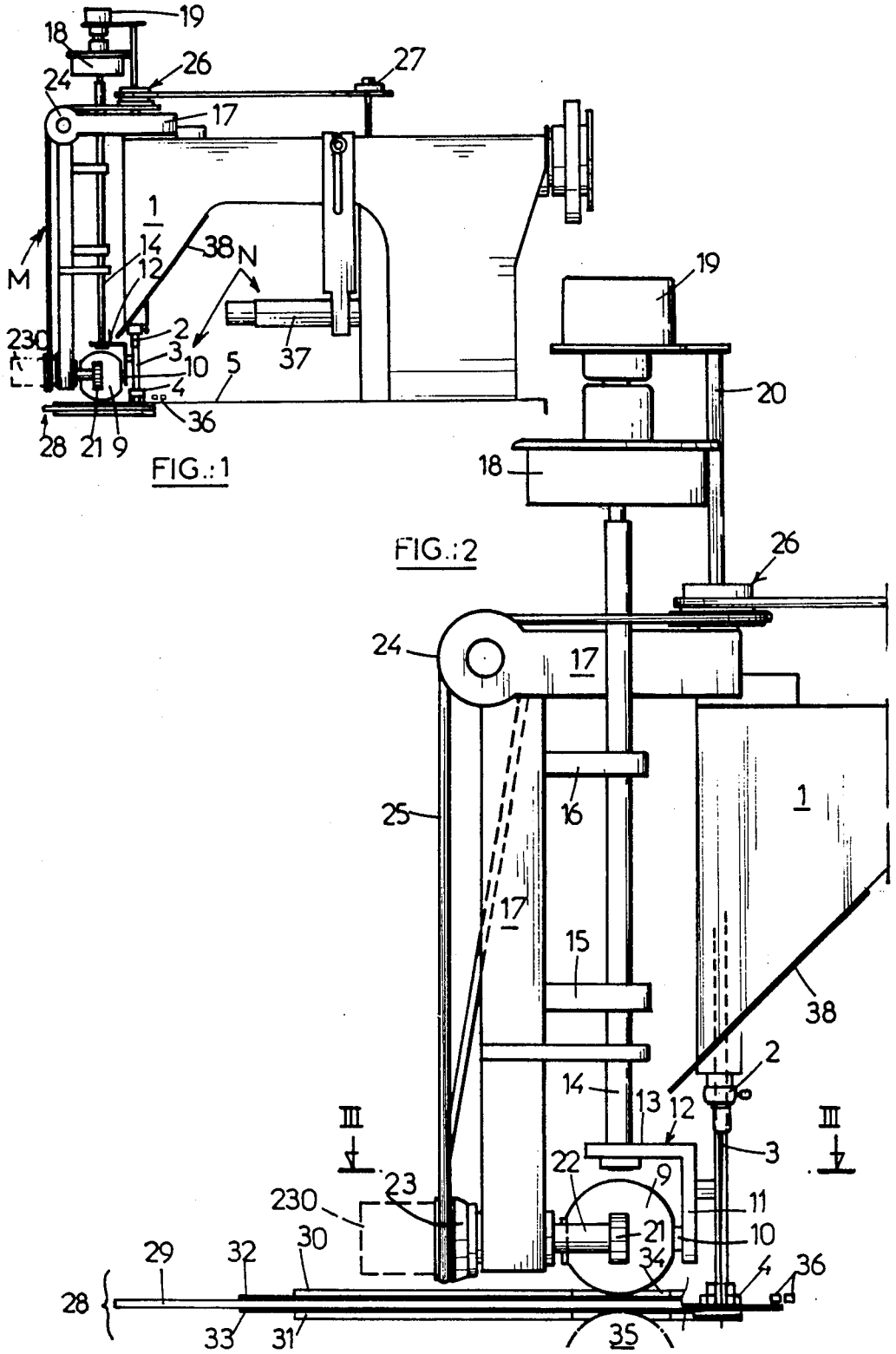
FIG. 1 shows a front view of a sewing machine fitted with the guidance unit, including a drive device and an edge detector according to the invention.
FIG. 2 is a view of the drive device on a larger scale.

FIGS. 1 to 3 show a sewing machine fitted with a guidance unit including a drive device M and an edge detector N.

The drive device is shown at a larger scale in FIG. 2, mounted on a machine head containing the actuating mechanism of the needle shaft 2 at the end of which is fixed the needle 3 and the pressure foot 4 lowering and raising mechanism.

The head also includes the mechanism conveying and guiding the thread to the needle (not shown).

In a known way, the table 5 (FIG. 3) carries the needle plate 6 in which are provided openings for the passage of the feed means formed by the claw 7 and a hole for the passage of the needle 8. The claw is given an alternating movement which causes the teeth to project from the plate simultaneously with their forward movement towards the rear of the machine (for an observer looking at the machine according to FIG. 1), the return of the claw being made with the teeth below the plate. The table also carries the mechanism for forming the stitch by interlocking the needle thread with the bobbin thread.

Once positioned, the pieces of material to be assembled by sewing are placed on the needle plate where they are held by the pressure of the raisable pressure foot.

The synchronization of the various movements of the mechanical parts of the machine is designed in such a way that when the needle passes through the pieces of material in order to make the interlocking of the sewing threads, these pieces are held stationary. When this operation is completed and the needle rises and comes out of the material, the claw projects from the needle plate and presses the material against the pressure foot and drives it to the rear bringing a length of material corresponding to the length of the stitch between the pressure foot and the needle plate.

When the guidance of the pieces of material must lead to the formation of non-rectilinear sewing, it is necessary to displace the piece or pieces of material around the needle using the needle as a center of rotation. This guidance can only be carried out when the needle is in the low position during the threads interlock phase.

According to the embodiment shown, the drive device according to the invention is positioned in front of the needle plate and includes a spherical wheel 9 which bears on one of the pieces of material to be guided. The wheel moves freely around a spindle 10, parallel to the surface of the material, fixed by one of its ends to one arm 11 of a square 12 whose other arm 13 is fixed to a shaft 14, that can turn about its axis in bearings 15, 16 fixed to a fixed frame 17. The shaft 14 and the spindle 10 of the wheel are, according to this embodiment, perpendicular and the axis of the shaft 14 passes through the center of the spherical wheel.

The shaft 14 is provided with an angular position measuring device 18 formed, for example, by a circular potentiometer and carries at its free end the means of control of rotation formed by a servo-motor 19 controlled by an electronic edge detection device which will be described later. The stators of the potentiometer and the servo-motor are fixed by a crosspiece to the fixed frame 17.

The wheel 9 is driven in rotation about its spindle 10 by a roller 21 whose spindle 22 is in a plane containing the spindle 10 of the wheel, preferably in the horizontal plane orthogonal to the shaft 14. The roller occupies a fixed position with respect to the frame 17 on which it is held by a bearing.

According to the embodiment shown, the roller is driven in rotation by a mechanical transmission formed at least in part from a system of pulleys 23, 24 and a belt 25. This assembly is itself driven by a transmission 26 directly or indirectly connected to a drive point 27 on the main shaft of the machine. The speed of rotation thus provided to the roller is coupled to that of the machine and consequently depends on the speed at which the pieces are fed under the stitch-forming mechanism.

The roller 21 drives the spherical wheel 9 in circles whose diameter depends on its orientation. Since the driving of the piece of material is always carried out at a same point situated on an outer circle of the wheel, the speed at this point will vary in a way which is inversely proportional to the diameter of the circle along which the roller will drive the wheel.

FIG. 4 makes it possible to understand the principle of the variation in the speed of drive as a function of the position of the wheel in front of the roller whose speed is considered as constant.

There has been represented in a first position I (in full lines) the spherical wheel 9 oriented such that its plane of symmetry is merged with the plane of symmetry of the roller 21. The roller is applied to the wheel along its outer circle of radius R in order to provide it with a tangential velocity, represented by the vector $\vec{Vo}$, approximately equal to a coefficient k times the constant velocity Vg of the roller ($k\ Vg=\vec{Vo}$).

In a second position II (in broken line) the vertical plane of symmetry of the wheel is turned, for example to the right, through an angle $\alpha$. The spindle of the wheel, perpendicular to the plane of symmetry, also turns through the same angle by presenting before the roller 21 a circle of radius R1 less than R and equal to R cos $\alpha$. It follows that the tangential velocity at the point of contact of the outer circle with the piece of material increases and becomes $V_1=Vo/\cos\alpha$. Vo can be considered as a component of the velocity $V_1$ and has been chosen, for reasons which will be explained later, equal to the forward velocity of the claw and in the same direction.

According to a variant, the synchronous mechanical drive of the main shaft movement of the machine is replaced by a servomotor 230 (shown in broken lines) enabling the wheel to be provided, by means of the roller, with a tangential velocity producing a drive of the piece to be guided at a speed of which one component parallel to the direction of movement of the claw is constant and equal to the feed speed of the pieces to be assembled.

In order to enable easy orientation of each piece of material before their assembly, the guidance unit includes a separating device 28 formed from a bearing plate 29 contained between two support plates 30, 31 respectively positioned above and below the plate 29 and at a distance from the bearing plate corresponding approximately to the thickness of the pieces of material 32, 33 to be assembled.

The support plates have an opening 34 allowing the passage of the wheel of the device driving the piece of material, the wheel being pressed against the said piece of material.

According to one application of the drive device to a guidance unit of a sewing machine, each of the pieces of material is guided before being assembled. The piece of material 33 passing between the support plate 31 and the bearing plate 29 is guided by a device in every way similar to the first one, which is suggested in FIG. 2 by a section of wheel 35 represented in dot-and-dash lines, possibly arranged opposite the first one with respect to the bearing plate.

The guidance of the pieces of material is carried out, as is known, by their edges: at least one of the edges being cut along the curve, projected on the plane of the material, of the desired assembly and serving as a reference. The guidance unit also includes an edge detector B which includes means of detection of the edge formed from a proportional photodetector 36 which will be described later.

The signals provided by the photodetector 36 are sent into an electronic device which detects the source of the signals and generates a signal which is sent into a comparator of which one of the inputs receives a reference signal taking account of the orientation of the wheel given by the potentiometer 18. The resultant signal controls an automatic control device including the servo-motor 19 which controls the orientation of the wheel 9 in front of the roller 21.

Figure 5:
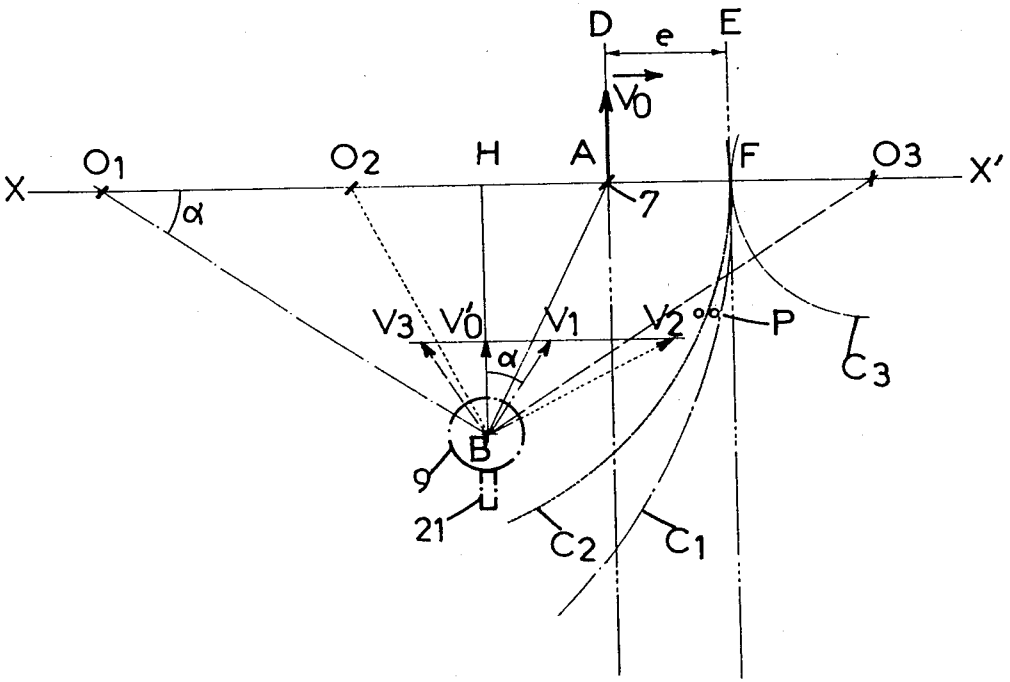
FIG. 5 shows a basic geometric construction explaining the operation of the guidance unit.

FIG. 5 is a geometric construction making it possible to understand the operation of the guidance device.

The straight lines D and E respectively correspond with a straight sewing obtained by maintaining the distance e from the rectilinear edge E of the piece of material to the needle A constant.

This piece of material is driven by the claw placed in front of the needle, at a velocity Vo which is represented in magnitude and direction by the vector $\vec{Vo}$ applied approximately at point A, as will be explained later.

A curved line is followed by superimposing a movement of rotation of the material on the feed given by the claw. The material, which is assumed to be a rigid plane, is provided with a field of velocity which can be expressed by the rotation about an instantaneous center of rotation $0_1$, $0_2$, $0_3$ . . . . This instantaneous center is situated at the intersection of all the perpendiculars to the velocity vectors at each point of the material. In particular, the perpendicular XX' to the velocity vector $\vec{Vo}$ given by the claw is a constant whatever may be the curvature of the sewing since this velocity is tangential to the sewing by definition. The instantaneous center of rotation is therefore always on this perpendicular. It will be assumed that this perpendicular passes through the needle A, which is only approximately true.

In order to define the required velocity field, there is applied at a point B, other than the needle A, by means of the wheel 9, a velocity defined in orientation and magnitude by a vector $\vec{V_1}$ for example.

In order to avoid a distortion of the plane of the material between the drive points A and B, it is necessary for the vector $\vec{V_1}$ to have a component $\vec{V'o}$ of the same orientation and magnitude as the vector $\vec{Vo}$ applied to point A. This component $\vec{Vo}$ has a value of $\vec{V_1}\cos\alpha=\vec{Vo}$. The angle $\alpha$ is the angle made by the diametral plane of the wheel passing through the point of application B; this is also the angle made by the horizontal axis of the wheel with the straight line XX', the point of intersection $0_1$ being an instantanenous center of rotation. Point $0_1$ is the center of a curve $C_1$ of radius equal to $0_1F$, F being the point of intersection of the edge of the material with the straight line XX'.

A modification of the radius of curvature of the sewing will be obtained by modification of the orientation and magnitude of the velocity vector $\vec{V_1}$. For example, the curve $C_2$ will be obtained by the application of a new velocity vector $\vec{V_2}$ which will give rise to a displacement of the instantaneous center of rotation to $0_2$.

It should be noted according to the embodiment shown in FIG. 4 that the orientation of the wheel is limited on either side of the direction BH to an angle less than 45° depending on the size of the horizontal spindle on which the wheel rotates.

When the velocity vector is orientated in the right-hand section of the part of the drawing limited by the straight line BH, the curves obtained will be convex. When it is orientated in the left-hand section, the curves obtained are concave.

An example of this latter case corresponds with the vector $\vec{V}_3$.

Figure 6:
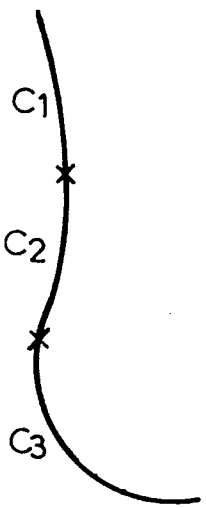
FIG. 6 is an example of curves along which an assembly is made.

The instantaneous center of rotation is then at $0_3$ and the concave curve $C_3$ is obtained. It is evident that this latter case is of value as an example and can only be applied to a sewing of a plane and non-three-dimensional assembly. FIG. 6 illustrates the curved sewing obtained with the various instantaneous centers of rotation.

The edge detector P must be postioned in such a way that the photodetector cells are on either side of the theoretical path of the edge of the piece to be guided. Their position determines the distance "e" between the sewing and the edge of the material. If the sewing must have a succession of different curves, the position of the cells must theoretically be modified as a function of the progression of the sewing in order to maintain e constant. An equivalent result can be obtained by using a row of cells of which only the two enclosing the theoretical path of the edge for the desired curve are activated. In practice, the precision sought often does not necessitate this correction.

The choice of drive point B is dictated by the sewing to be performed and depends on the distance of this point from the closest edge. It can, depending on the curvature of the sewing to be carried out, be located on the other side of the straight line D passing through the needle.

This position is easily determined by a specialist in the field.

The angular position of the drive wheel 9 is marked by the potentiometer 18 while the position of the edge of the material is marked by the edge detector B comprising, according to the embodiment shown, the photoelectric detector 36 arranged in an enclosure 37 fixed to the arm of the machine. A mirror 38 transmits the light beam onto the polished bearing plate 29 on which it is reflected. The reflected beam falls on the photoelectric sensor formed from a strip of diodes mounted on an integrated circuit in steps of 0.1 mm. The strip used, in the application described includes 64 diodes, which permits an aiming range of 6.4 mm which is considered sufficient. The size of the diodes (0.1 mm) was chosen such that their width is less than the diameter of the threads forming the material and, in particular, than those forming the network of stitches of the net or of the lace. The position of the thread can therefore be detected to the nearest 0.1 mm, which is sufficient to obtain a sewing accuracy of ±0.5 mm.

The light rays which fall on the material are diffused with a low intensity while those which fall to the side or inside the gaps are reflected and concentrated by the optics onto the diode strip. This results in a set of signals which are weak opposite the material and strong away from it.

These signals are processed in order to find the edge and then the cut, taking account of the fact that the shape of the contour due to the gaps can be disguished from that due to the cut as a consequence of the difference in the radii of curvature (a few millimeters for a gap versus 30 millimeters at the minimum for the cut) during the progression of the edge in front of the diode strip, a progression due to the feed movement imposed on the material by the claw.

The state of the various diodes 36 (FIG. 7) is observed by a cyclic scanning timed by the signals 40 of a clock and defined by the synchronization signals 41 from a multiplexer 42 in order to form a video signal. The timing diagrams of the signals, shown in FIG. 8, correspond, in order to simplify the diagram, with a strip of ten photodiodes, whereas the embodiment uses a strip of 64 photodiodes.

On the video signal, each level represents the illumination of a photodiode. The diagram corresponds with three successive scannings I, II, III triggered by the three synchronization signals A, B, and C and with a single displacement of the material, which explains the modification of the signal between each synchronization.

During the first scan I, two low levels can be observed between the higher levels; the low levels correspond with a hole in a lace stitch.

The absence of the material should give a zero level but in practice the level is not zero. In order to separate clearly the signals corresponding with the presence or with the absence of material, a threshold 43 is defined with which the signals are compared. The comparator 44 which receives the threshold signal and the video signal, separates the levels and enables an all-or-nothing signal 45 to be obtained.

The output of the comparator 44 is sent to a bistable flip-flop circuit 45. During the scanning of the strip, the first presence of the material encountered generates a signal which makes the bistable switch to the 1 state shown in FIG. 8; this is only reset to the 0 state at the end of the scan, i.e. on arrival of the next synchronization signal A. Consequently, only the edge of the material is taken into account and not the possible holes. A gate circuit 46 controlled by the output signal of the bistable allows a number of clock signal pulses 40 to pass, which is proportional to the position of the first photodiode marked by the edge of the material.

A counting circuit 47, triggered by a synchronization signal 41, determines the number of pulses contained in each output signal of the bistable passing through the gate circuit 46, between two synchronization signals 41. The result of the count is then transferred into a transfer register 48 by a transfer control circuit 49 which also provides the resetting to zero of the counter 47, controlled by the synchronization signal after a time shift.

The value of the count previously obtained is converted into a voltage by a digital-analog converter 50. A signal is thus obtained which is proportional to the distance separating the edge of the material from the edge of the strip.

This edge signal faithfully follows the shape obtained after the cutting including the contour of the gaps cut by the line of cut in perforated materials.

A second processing of the signal is necessary in order to reconstruct the line of cut, and will consist in carrying out a peak-to-peak following of the edge signal, in order to skip the gaps.

It has been stated that the apparent curvature of the material in the region of the sensor causes very slow signal variations compared with those caused by the gaps. It is therefore possible to limit the variations of the signal in the direction of the hollows of the gaps according to a slope value corresponding with that which is noted in the case of maximum apparent curvature which, in the example of embodiment is 30 mm.

The analog signal obtained in the first processing is sent into a correcting circuit 51 which converts it into a peak signal. This correction is obtained from two time constants, a short one which reaches the maximum value rather quickly and a longer one which enables the minimum curve acceptable by the material guidance to be followed.

The signal obtained at the output of the correcting circuit 51 is sent into a centering circuit 52 where it is calibrated and comes out in the form of a signal $e_2$.

The signal coming from the angular position sensor 18 is also sent into a centering circuit 53 where it is calibrated in the form of a signal $e_1$.

The signals $e_1$ and $e_2$ are sent into a comparison and control circuit 54 which is formed (FIG. 9), according to the example, from at least three comparator circuits 55, 56 and 57 (for example SIEMENS TCA 965) whose outputs are connected to three relays 58, 59 and 60. Circuit 58 enables the speed of the servo-motor 19 to be limited by inserting a series resistor R, and circuits 59 and 60 define the direction of rotation ROT+ and ROT− and the stoppage of the motor by the presence of a same polarity at its terminals.

The comparator 55 receives the signal $e_1$ which it compares with two stop values, maximum and minimum. These two values are sent to the comparator 57 which receives the values of $e_1$ and $e_2$. One of the relays 59 of the motor circuit is activated by the signal $e_1 > e_2 + \epsilon_1$, $\epsilon_1$ being the trigger value, the other relay 60 is activated by the signal $e_1 < e_2 - \epsilon_1$.

If both relays are in the same state, the motor has the same polarity at its terminals and remains stationary, otherwise it rotates in one direction or the other.

The comparator 56 compares the absolute value of the difference of the signals $e_1$ and $e_2$ with a trigger value $\epsilon_2$ in order to connect or disconnect a speed-limiting resistor in respect of the motor circuit.

In this example of embodiment, it has been assumed that the tangential velocity of the drive wheel varied automatically with its orientation, i.e. that the drive device included a spherical wheel driven by a roller 21 at constant velocity such as described above.

It is obvious that a device which did not include this feature would require circuit for powering the servomotor 230 of the drive wheel, which is capable of providing a variable power supply voltage according to the orientation $\alpha$ of the wheel.

We claim:

1. Apparatus for the guidance of sheets of flexible material for the purpose of forming a three-dimensional assembly, said apparatus including a drive device formed from at least one bearing plate, a drive wheel constructed and arranged to press flexible sheet material to be guided onto said bearing plate, means for control of said drive wheel, and a position detector for detecting the position of an edge of sheet material on said bearing plate, said detector including at least one photoelectric detector placed in front of said edge used in the guidance of said sheet material and electronic circuits converting the signals provided by said detector into a control signal for said drive device, wherein the drive device includes a spherical drive wheel which moves freely around a spindle, said spindle being parallel to a bearing plate and said spindle being attached at one end to an axially movable shaft by an extension, said extension being approximately orthogonal to said bearing plate and said shaft, said shaft having a means of rotational control provided at the end of said shaft opposite the end attached to said spindle by said extension; and a drive roller having an axis which is parallel to said bearing plate and which controls the rotation of said spherical drive wheel, wherein said shaft and said drive roller are supported by common frame means which provide the appropriate angular positions of said shaft and said drive roller.

2. The apparatus of claim 1 wherein the drive wheel has at its point of contact with said sheet material a tangential velocity ($V_1$) which is variable according to the cosine of the angle ($\alpha$) that its plane of symmetry, perpendicular to its axis, makes with the plane of symmetry of the drive roller at constant velocity ($V_g$).

3. the appartus of claim 2 wherein one component ($\vec{V'o}$) of velocity vector ($\vec{V_1}$) of the drive wheel is parallel to and equal to the velocity vector ($\vec{Vo}$) of the drive means.

4. The apparatus of claim 1 wherein said position detector includes a photoelectric detector comprising a sensor formed by a strip of photoelectric diodes and a light source, a light beam emitted by the source being reflected on said bearing plate over which the edge of said sheet material passes, a multiplexer forming a video signal from the signals of each diode, a comparator to separate the levels of the video signal into all or nothing, a bi-stable flip-flop circuit going from the 1 state by the first presence of material encountered to the 0 state at the end of the scan of the strip, a gate circuit allowing a number of clock pulses to pass which are proportional to the position of the first diode masked by the edge of said sheet material, a counting circuit, a transfer register and a digital-analog converter, the output voltage corresponding faithfully to the contour of the observed edge, a hole-correction circuit to convert the output signal produced by perforated materials into a peak-to-peak signal, a comparison and control circuit comparing the processed signal coming from the correction circuit, and the position signal coming from the position sensor in order to control the orientation and velocity of the drive device.

5. The apparatus of claim 4 wherein the photodiodes forming the strip have a maximum diameter of less than that of the threads forming the stitches of the perforated material.

6. The apparatus of claim 4 wherein the comparison and control circuit includes three integrated comparator circuits, a first comparator circuit receives the processed signal ($e_2$) from the diode strip and compares it with two stop values, maximum and minimum ($S_1$, $S_2$), a second comparator circuit receives the two previous stop values and the signals ($e_1$, $e_2$) coming from the diode strip and from the position sensor the outputs of the comparator circuits giving two signals, greater than or less tahn a reference value ($e_2$) increased or reduced by a trigger value ($\epsilon_1$), activating relays controlling a servo-motor for the orientation of the drive device; a third comparator circiut comparing the signal ($e_1$) coming from the position sensor and the signal ($e_2$) from the diode strip with a reference value ($\epsilon_2$) in order to include a resistor in the power supply circuit of the servomotor in order to limit it speed.

7. The apparatus of claims 3 or 4 wherein the drive hweel is driven in roattion by a servo-motor and wherein the edge detector includes a circuit for powering the servomotor providing a power supply voltage which is variable according to the orientation ($\alpha$) of the wheel.

* * * * *